US005132034A

United States Patent [19]

Hsu et al.

[11] Patent Number: 5,132,034

[45] Date of Patent: Jul. 21, 1992

[54] THIOESTER DERIVED HINDERED PHENOLS AND ARYL-AMINES AS ANTIOXIDANT AND ANTIWEAR ADDITIVES

[75] Inventors: Shih-Ying Hsu, Morrisville, Pa.; Andrew G. Horodysky, Cherry Hill, N.J.

[73] Assignee: Mobil Oil Corp., Fairfax, Va.

[21] Appl. No.: 697,038

[22] Filed: May 8, 1991

[51] Int. Cl.[5] ..... C10M 105/42; C10M 105/36; C07C 327/22

[52] U.S. Cl. ..... 252/47.5; 252/48.6; 558/255

[58] Field of Search ..... 252/47.5, 48.6, 402, 252/404; 560/195, 180, 193, 144, 130, 156, 171, 155; 558/255

[56] References Cited

U.S. PATENT DOCUMENTS

| | | | |
|---|---|---|---|
| 3,598,854 | 8/1971 | Steinberg | 558/255 |
| 4,446,264 | 5/1984 | Cottman | 560/144 |
| 4,633,008 | 12/1986 | Oonishi | 560/193 |
| 4,863,622 | 9/1989 | Chiu | 252/48.6 |

*Primary Examiner*—Prince Willis, Jr.
*Assistant Examiner*—T. Steinberg
*Attorney, Agent, or Firm*—Alexander J. McKillop; Charles J. Speciale; Howard M. Flournoy

[57] ABSTRACT

Thioester derived hindered phenols & thioester derived arylamines are effective antioxidant and antiwear additives for lubricants and fuels.

21 Claims, No Drawings

THIOESTER DERIVED HINDERED PHENOLS AND ARYL-AMINES AS ANTIOXIDANT AND ANTIWEAR ADDITIVES

BACKGROUND OF THE INVENTION

1. Field of the Invention

This application is directed to thioester derived hindered phenols and thioester derived arylamines as antioxidant and antiwear additives for lubricants and fuels and to compositions containing same.

2. Description of Related Art

Arylamines and hindered phenols have been traditionally and extensively used as oxidation inhibitors and sulfur-containing compounds as antiwear compounds for lubricants. We have found that specific combinations of arylamines or hindered phenols with sulfur-containing compounds can result in a synergistic mixture and give a much enhanced antioxidative stabilization for lubricants. Disclosed in this patent application are examples of effective combinations of arylamines or hindered phenols with sulfur-containing compounds for lubricant compositions. These same compositions also provide remarkable EP/antiwear activity. Improvements in anti-fatigue, antirust, cleanliness, antifatigue, extreme pressure, antistaining, detergent, anti-corrosion and demulsibility properties are also expected. These unique additives can also be used in hydrocarbon, oxygenated or mixed fuels for any of the above purposes.

This invention more particularly provides highly effective multifunctional antioxidant and antiwear additives for lubricant and fuel compositions comprising thioester derived arylamines and hindered phenols and fuel and lubricant compositions comprised thereof. The invention accordingly provides these additives in a new class of novel compositions.

This case of antioxidants consist of the reaction products of arylamines (such as Vanderbilt's Vanlube 81) or hindered phenols (such as Ethyl Corp.'s Ethanox 754 with hydrocarbyl e.g., alkenyl or polyalkenyl, e.g., polyisobutenyl anhydrides and thioesters (such as glycol dimercaptoacetate). We have found that these additives are very effective antioxidant and antiwear compositions for lubricant applications. To the best of our knowledge, the syntheses, uses, and applications of this family of antioxidants to lubricant and fuel compositions have not been reported elsewhere or used commercially, and are therefore novel.

An object of this invention is to provide improved lubricant and fuel compositions having increased multifunctional antioxidant and antiwear characteristics. It is, also, an object of this invention to provide novel multifunctional lubricant and fuel additives and novel uses of the described additives in such compositions.

DESCRIPTION OF THE PREFERRED EMBODIMENTS

The arylamine and hindered phenol-derived antioxidant and antiwear compounds can be generally prepared as described in FIGS. 1 and 2.

(FIG. 1)

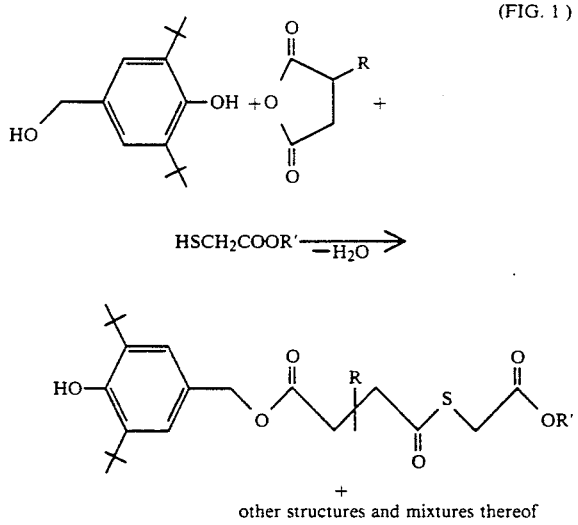

(FIG. 2)

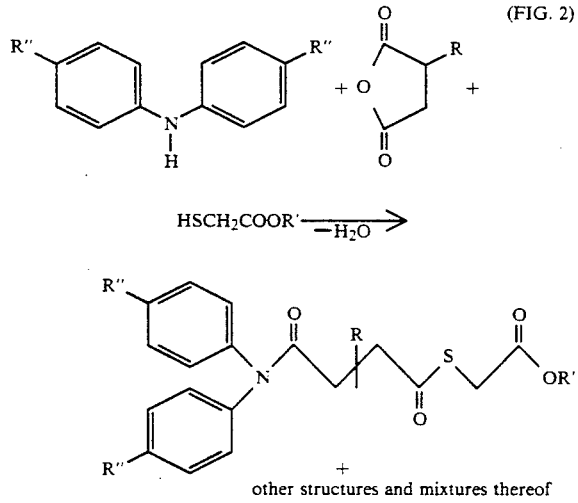

other structures and mixtures thereof where R=hydrogen or $C_1$ to about $C_{120}$ hydrocarbyl, such as alkyl or alkenyl or a polyhydrocarbyl such as polyisobutenyl, or polypropenyl and can optionally contain sulfur, nitrogen and/or oxygen; R' and R''=hydrogen or hydrocarbyl, hydrocarbyl is $C_1$ to about $C_{120}$, preferably $C_1$-$C_{18}$, and is selected from the group consisting of alkyl, alkenyl, alkaryl, aralkyl or aryl and can optionally contain sulfur, nitrogen and/or oxygen.

The hindered phenol (Ethanox 754) and arylamines (Vanlube 81) shown here are only for demonstration purposes. Other hindered phenols and arylamines can also be used. The reaction sequences can be in separate reactors or one-pot fashion. For instance, hindered phenols can react with the anhydrides first, followed by alkyl thioglycolate, or simply the three substrates can be added together to react. A variety of anhydrides, preferably succinic anhydrides such as 2-dodecen-1-ylsuccinic anhydride, can be used to prepare this category of compounds which generally exhibit good antioxidancy and antiwear properties. In addition to iso-decyl thioglycolate, other thioesters have been used in the preparation described in FIGS. 1 and 2, such as glycol dimercaptoacetate, trimethylolpropane trimercaptopropionate, pentaerythritol tetramercaptopropionate, etc. The reaction products obtained are generally yellowish oils and have good solubility in mineral and synthetic base stocks.

The hindered phenols and arylamines derivatized with acid anhydrides and thioesters as described in FIGS. 1 and 2 are, accordingly, a novel new class of compounds which exhibit good antioxidant and antiwear properties in mineral oils under severe service conditions. These properties enhance the thermal and oxidative stability of premium quality automotive and industrial lubricants and fuels to extend their service life and improve their performance characteristics.

Other suitable arylamines include but are not limited to mono-tertiary-alkyl-diarylamines, dialkyl-diarylamines, such as diphenylamine and phenyl-alpha-naphthalene and their alkylated derivates such as di(octylphenyl)amine.

Suitable hindered phenols include but are not limited to 2,6-ditertiary-butyl-p-cresol, 2,6-t-butyl -4-hydroxymethylphenol and the like.

Conditions for the above reactions may vary widely depending upon specific reactants, the presence or absence of a solvent and the like. Any suitable set of reaction conditions known to the art may be used. Generally stoichiometric quantities of reactants are used. However, more than molar or less than molar or equimolar amounts may be used. Preferably, the reaction temperature may vary from ambient from about 90° C. to about 200° C., under atmospheric pressure, and the molar ratio of reactants generally equimolar or one of the reactants may be in a slight excess.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %. It is expected that these materials would also be suitable for use in liquid hydrocarbyl or alcoholic or oxygenated or mixed hydrocarbyl/alcoholic or oxygenated fuel compositions. They are utilized in fuels in amounts of from about 25 to 500 pounds of additive per thousand barrels of fuel and preferably from about 50 to about 250 pounds per 1000 barrels of fuel.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. to about 6000 SSU at 100° F. and preferably, from about 50 to about 250 SSU at 210° F. These oils may have viscosity indexes ranging to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps such as lithium hydroxysterate soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which is normally employed for thickening or gelling hydrocarbon fluids for foaming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers. Ester-based lubricants are highly suitable.

The fuels contemplated are liquid hydrocarbon combustion fuels, including oxygenated and alcoholic fuels as well as distillate fuels and fuel oils.

It is to be understood, however, that the compositions contemplated herein can also contain other materials. For example, corrosion inhibitors, extreme pressure agents, low temperature properties modifiers and the like can be used as exemplified respectively by metallic phenates sulfonates, polymeric succinimides, non-metallic or metallic phosphorodithioates and the like. These materials do not detract from the value of the compositions of this invention, rather the materials serve to impart their customary properties to the particular compositions in which they are incorporated.

The following examples are merely illustrative and not meant to be limitations.

EXAMPLE 1

To a mixture of 2,6-t-butyl-4-hydroxymethylphenol (commercially obtained from Ethyl Corp. as Ethanox 754) (23.6 g, 0.1 mol) in toluene (100 ml) was added 2-dodecen-1-ylsuccinic anhydride (26.6 g, 0.1 mol). The mixture was briefly refluxed for about 30 min., cooled to 5.C and iso-decyl thioglycolate (23.2 g, 0.1 mol) was added. The resulting solution was refluxed for an additional 5 hours or until 1.8 ml water was collected. The solvent was evaporated to afford a yellowish oil (70 g, 97%).

EXAMPLE 2

To a mixture of di(octylphenyl)amine (commercially obtained from Vanderbilt Corp. as Vanlube 81) (40 g, 0.1 mol) in toluene (100 ml) was added 2-dodecen-1-ylsuccinic anhydride (27 g, 0.1 mol). The mixture was refluxed for 2 hours and iso-decylthioglycolate (23.6 g, 0.1 mol) was added. The resulting solution was refluxed for an additional 5 hours, cooled to 25° C. The solvent was evaporated to afford a yellowish oil (89 g).

EXAMPLE 3

To a mixture of 2,6-t-butyl-4-hydroxymethyl phenol (47.2 g, 0.2 mol) in toluene (100 ml) was added 2-dodecen-1-ylsuccinic anhydride (53.2 g, 0.2 mol). The mixture was refluxed for 1 hour, cooled to 25° C. and glycol dimercaptoacetate (21 g, 0.1 mol) was added. The solvent was evaporated to provide a yellowish oil (115 g).

EXAMPLE 4

To a mixture of di(octylphenyl)amine (39.3 g, 0.1 mol) in toluene (100 ml) was added 2-dodecen-1-ylsuccinic anhydride (26.6 g, 0.1 mol). The mixture was refluxed for 2 hours, cooled to 25° C. and glycol dimercaptoacetate (10.5 g, 0.05 mol) was added. The resulting solution was refluxed for an additional 3 hours and the solvent was evaporated to afford a yellowish oil (73 g).

EVALUATION OF PRODUCTS

The arylamines and hindered phenols obtained as described in the examples were blended into mineral oils and evaluated for antioxidant/antiwear performance by the Catalytic Oxidation Test at 325° F. for 40 hours (Table 1) and the Four-Ball Wear Test at 60 kg load/2000 rpm/200° F. for 30 min. (Table 2). A comparison of the oxidation-inhibiting characteristics of the novel products with other traditional commercial arylamine antioxidants in the same mineral oil is also included in Table 1.

CATALYTIC OXIDATION TEST

Basically, in the catalytic oxidation test, the lubricant is subjected to a stream of air which is bubbled through at the rate of five liters per hour at elevated temperatures for a specified time (Table 1, 325° F. for 40 hours). Present in the composition are samples of metals commonly used in engine construction, namely, iron, copper, aluminum, and lead. See U.S. Pat. No.3,682,980, incorporated herein by reference.

FOUR BALL WEAR TEST

In the Four-Ball Wear Test, three stationary balls are placed in the lubricant cup and the lubricant containing the compound to be tested is added thereto, and a fourth ball is placed in a chuck mounted on a device which can be used to spin the ball at known speeds and loads. The samples were tested using ½ inch stainless steel balls of 52100 steel for 30 minutes. See Table 2.

TABLE 1

| | Catalytic Oxidation Test (325° F., 40 hrs) | | |
|---|---|---|---|
| Item | Additive Concentration (wt %) | Change in Acid Number Δ TAN | % Change in Viscosity Δ KV, (%) |
| Base oil (200 second, solvent refined, paraffinic neutral mineral oil) | None | 11.97 | 210 |
| Commercial Arylamine Antioxidant (Ciba-Geigy Irganox L-57) in above oil | 1.0 | 6.42 | 80.5 |
| Example 1 in above oil | 1.0 | 6.29 | 68.4 |
| Example 2 in above oil | 1.0 | 2.33 | 46 |

TABLE 1-continued

| | Catalytic Oxidation Test (325° F., 40 hrs) | | |
|---|---|---|---|
| Item | Additive Concentration (wt %) | Change in Acid Number Δ TAN | % Change in Viscosity Δ KV, (%) |
| Example 3 in above oil | 1.0 | 5.11 | 75.5 |
| Example 4 in above oil | 1.0 | 2.31 | 38.6 |

TABLE 2

| | Four-Ball Wear Test 60 kg/2000 rpm/30 min/200° F. | |
|---|---|---|
| Item | Additive Concentration (wt %) | Wear Scar Diameter mm |
| Base oil (80% solvent paraffinic bright, and 20% solvent paraffinic neutral lubricant oils) | None | 3.48 |
| Example 1 in above oil | 1.0 | 2.63 |
| Example 2 in above oil | 1.0 | 2.08 |
| Example 3 in above oil | 1.0 | 2.25 |
| Example 4 in above oil | 1.0 | 0.97 |

It is clear that from Table 1 that the thioester derived hindered phenols exemplified by Examples 1 to 4 exhibit excellent antioxidant activity in mineral oils as compared with a commercially available arylamine. These additives can also be very effective when used in synthetic lubricants. The compositions in accordance with the invention are an entirely new class of compounds which exhibit very good antioxidant and antiwear properties in mineral and synthetic lubricants under severe service conditions as evidenced by above test data. These properties can enhance the thermal and oxidative stability of premium quality automotive and industrial lubricants to extend their service life.

What is claimed is:

1. An improved lubricant composition comprising a major proportion of said lubricant and a minor proportion of a multifunctional antiwear, antioxidant additive product prepared by the reaction of:

(A) one of either a hindered phenol or an arylamine, with (B) a hydrocarbyl succinic anhydride, and (C) a thioester, in equimolar ratios or slightly in excess of any one of the reactants at temperatures varying from ambient to about 200° C., under atmospheric pressure for a time sufficient to obtain a hydrocarbyl thioester derivative of an arylamine or a hindered phenol.

2. The composition of claim 1 wherein the additive product is prepared in the following manner:

(FIG. 1)

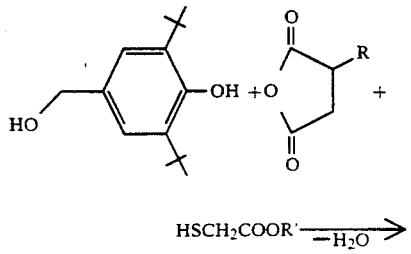

-continued

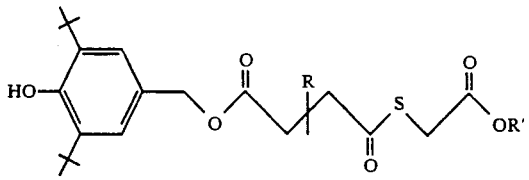

or

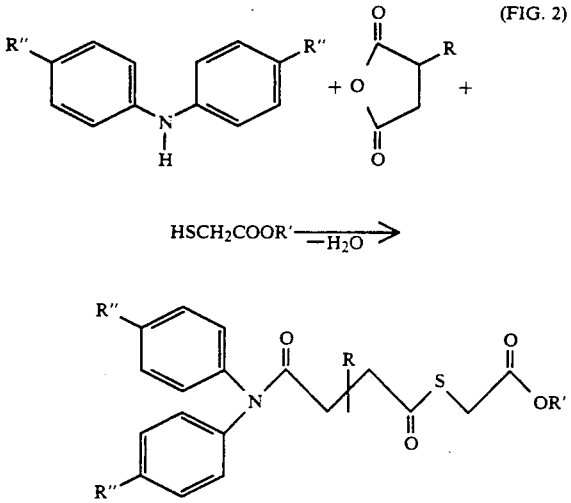

(FIG. 2)

Where R = hydrogen, or $C_1$–$C_{100}$ hydrocarbyl, polyhydrocarbyl optionally containing sulfur, nitrogen and/or oxygen; R′ and R″ = hydrogen or $C_1$ to about $C_{120}$ hydrocarbyl and optionally containing sulfur, nitrogen and/or oxygen and where hydrocarbyl is selected from the group consisting of alkyl, alkenyl, alkaryl, aralkyl or aryl.

3. The composition of claim 1 wherein the product containing at least one additive product of reaction having the following structural formula:

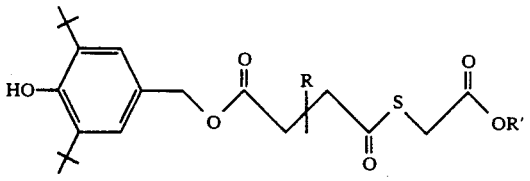

and wherein R = hydrogen or $C_1$ to about $C_{120}$ hydrocarbyl, or polyhydrocarbyl and optionally containing sulfur, nitrogen and/or oxygen; R′ = hydrogen or $C_1$ to about $C_{120}$ hydrocarbyl, and optionally containing sulfur, nitrogen and/or oxygen and where hydrocarbyl is selected from the group consisting of alkyl, alkenyl, alkaryl, aralkyl or aryl.

4. The composition of claim 1 wherein the product contains at least one additive product of reaction having the following structural formula:

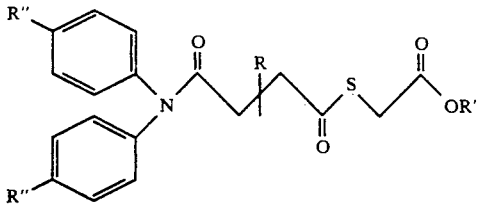

and where R = hydrogen or $C_1$ to about $C_{120}$ hydrocarbyl or a polyhydrocarbyl and optionally containing sulfur, nitrogen and/or oxygen; R′ = hydrogen $C_1$ to about $C_{120}$ hydrocarbyl, and optionally containing sulfur, nitrogen and/or oxygen and where hydrocarbyl is selected from the group consisting of alkyl, alkenyl, alkaryl, aralkyl or aryl.

5. The composition of claim 1 wherein the thioester derived hinderedphenol is prepared from 2,6-t-butyl-4-hydroxymethylphenol, 2-dodecen-1-ylsuccinic anhydride and iso-decyl thioglycolate.

6. The composition of claim 1 wherein the thioester derived arylamine is prepared from di(octylphenyl)amine, 2-dodecen-1-ylsuccinic anhydride and iso-decyl-thioglycolate.

7. The composition of claim 1 wherein the thioester derived hinderedphenol is prepared from 2,6-t-butyl-4-hydroxymethylphenol, 2-dodecen-1-ylsuccinic anhydride and glycol dimercaptoacetate.

8. The composition of claim 1 wherein the thioester derived arylamine is prepared from di(octylphenyl)amine, 2-dodecenyl-1-ylsuccinic anhydride and glycol dimercaptoacetate.

9. The composition of claim 1 wherein the lubricant is an oil of lubricating viscosity selected from the group consisting of (1) mineral oils, (2) synthetic oils, (3) or mixtures of mineral and synthetic oils or is (4) a grease prepared from any one of (1), (2) or (3).

10. The composition of claim 9 wherein the lubricant contains from about 0.001 to about 10 wt% based on the total weight of the composition of the additive product of reaction.

11. The composition of claim 9 wherein the lubricant is a synthetic oil.

12. The composition of 9 wherein the lubricant is a mineral oil.

13. A hydrocarbyl thioester derivative of an arylamine or a hindered phenol prepared by the reaction of:

(A) one of either a hindered phenol or an arylamine, with (B) a hydrocarbyl succinic anhydride, and (C) a thioester, in equimolar ratios or slightly in excess of any one of the reactants at temperatures varying from ambient to about 200° C., under atmospheric pressure for a time sufficient to obtain said derivatives.

14. A product of reaction in which accordance with claim 13 wherein the product contains at least one product of reaction having the following structure:

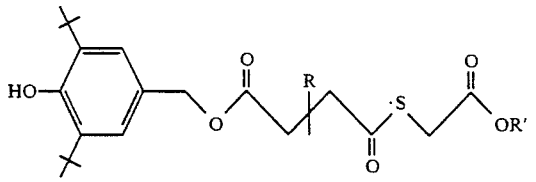

and where R=hydrogen or $C_1$ to about $C_{120}$ hydrocarbyl or a polyhydrocarbyl and optionally containing sulfur, nitrogen and/or oxygen; R'=hydrogen $C_1$ to about $C_{120}$ hydrocarbyl, and optionally containing sulfur, nitrogen and/or oxygen and where hydrocarbyl is selected from the group consisting of alkyl, alkenyl, alkaryl, aralkyl or aryl.

15. The product of claim 13 wherein the product contains the following structural formula:

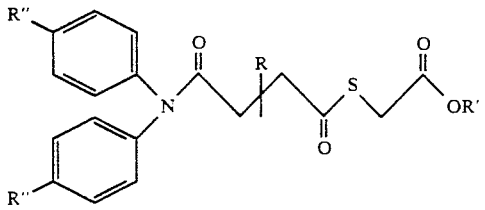

and wherein R=hydrogen or $C_1$–$C_{120}$ hydrocarbyl or polyhydrocarbyl and optionally contains sulfur, nitrogen and/or oxygen; R' and R''=hydrogen or $C_1$–$C_{120}$ hydrocarbyl and wherein hydrocarbyl is selected from the group consisting of alkyl, alkenyl, alkaryl, aralkyl, and aryl and optionally contains sulfur, nitrogen and/or oxygen.

16. The product of claim 13 wherein the thioester derived hinderedphenol is prepared from 2,6-t-butyl-4-hydroxymethylphenol, 2-dodecen-1-ylsuccinic anhydride and iso-decyl thioglycolate.

17. The product of claim 13 wherein the thioester derived arylamine is prepared from di(octylphenyl)amine, 2-dodecen-1 -ylsuccinic anhydride and iso-decyl-thioglycolate.

18. The product of claim 13 wherein the thioester derived hinderedphenol is prepared from 2,6-t-butyl-4-hydroxymethylphenol, 2-dodecen-1-ylsuccinic anhydride and glycol dimercaptoacetate.

19. The product of claim 13 wherein the thioester derived arylamine is prepared from di(octylphenyl)amine, 2-dodecen -1-ylsuccinic anhydride and glycol dimercaptoacetate.

20. A method of preparing an improved lubricant composition comprising adding to said lubricant a minor multifunctional antioxidant and/or antiwear amount of a product of reaction as described in claim 18.

21. The method of claim 20 wherein said composition is a lubricant composition and said minor amount is from about 0.001 to about 10 wt% based on the total weight of the composition of said additive product of reaction.

* * * * *